US005731034A

United States Patent [19]

Husband

[11] Patent Number: 5,731,034

[45] **Date of Patent: *Mar. 24, 1998**

[54] METHOD OF COATING PAPER

[75] Inventor: John Claude Husband, Cornwall, United Kingdom

[73] Assignee: ECC International Limited, United Kingdom

[ * ] Notice: The term of this patent shall not extend beyond the expiration date of Pat. No. 5,384,013.

[21] Appl. No.: 759,306

[22] Filed: Dec. 2, 1996

Related U.S. Application Data

[63] Continuation-in-part of Ser. No. 540,932, Oct. 11, 1995, abandoned, which is a continuation of Ser. No. 250,649, May 27, 1994, abandoned, which is a continuation of Ser. No. 984,565, Mar. 5, 1993, abandoned.

[30] Foreign Application Priority Data

Dec. 4, 1990 [GB] United Kingdom ..... 9026362

[51] Int. Cl.[6] ..... B05D 5/00

[52] U.S. Cl. ..... 427/288; 106/463; 106/464; 106/465; 106/468; 106/469; 106/770; 106/772; 106/784; 106/785; 162/126; 162/127; 162/181.2; 427/197; 427/391; 428/144; 428/153; 428/537.5; 501/144; 501/145; 501/146

[58] Field of Search ..... 427/197, 288, 427/391; 106/463, 464, 465, 468, 469, 470, 772, 784, 785; 428/144, 153, 537.5; 501/144, 145, 146; 162/181.2, 127, 126

[56] References Cited

U.S. PATENT DOCUMENTS

| | | | |
|---|---|---|---|
| 4,284,546 | 8/1981 | Delfosse et al. | 260/29.6 R |
| 4,738,726 | 4/1988 | Pratt et al. | 106/308 N |
| 4,799,964 | 1/1989 | Harvey et al. | 106/436 |
| 4,816,074 | 3/1989 | Raythatha et al. | 106/468 |
| 5,102,465 | 4/1992 | Lamond | 106/465 |
| 5,120,365 | 6/1992 | Kogler | 106/415 |
| 5,244,542 | 9/1993 | Bown et al. | 162/164.3 |
| 5,384,013 | 1/1995 | Husband et al. | 162/168.1 |

FOREIGN PATENT DOCUMENTS

| | | |
|---|---|---|
| 0278602 | 8/1988 | European Pat. Off. . |
| 2468688 | 5/1981 | France . |
| 62-223396 | 1/1987 | Japan . |
| 1308143 | 2/1973 | United Kingdom . |
| 1505641 | 3/1978 | United Kingdom . |
| 2139606 | 11/1984 | United Kingdom . |
| 2200104 | 7/1988 | United Kingdom . |
| WO 92/10609 | 6/1992 | WIPO . |

*Primary Examiner*—Bernard Pianalto
*Attorney, Agent, or Firm*—Klauber & Jackson

[57] ABSTRACT

A method of coating paper with a paper coating composition having a solids concentration of at least 45% by weight, consisting essentially of an aqueous cationic dispersion of a particulate calcium carbonate pigment and a nonionic or cationic adhesive, wherein the pigment has a particle size distribution such that no more than 1% by weight of the particles have an equivalent spherical diameter larger than 10 microns, at least 65% by weight of the particles have an equivalent spherical diameter smaller than 2 microns and not more than 10% by weight of the particles have an equivalent spherical diameter smaller than 0.25 micron, and wherein said pigment is dispersed with a combination of a cationic polyelectrolyte and an anionic polyelectrolyte, with the amount of cationic polyelectrolyte being in the range of about 0.01% to about 1.5% by weight, based on the weight of the dry pigment, and with the amount of anionic polyelectrolyte being in the range of about 0.01% to about 0.5% by weight.

22 Claims, No Drawings

METHOD OF COATING PAPER

CROSS-REFERENCE TO RELATED APPLICATIONS

This application is a continuation-in-part of application Ser. No. 08/540,932 filed Oct. 11, 1995, now abandoned, which is a file wrapper continuation of application Ser. No. 08/250,649 filed May 27, 1994, now abandoned, as a file wrapper continuation of application Ser. No. 07/984,565 filed Mar. 5, 1993, now abandoned.

BACKGROUND OF THE INVENTION

It is known to disperse inorganic pigments and fillers such that the particles have an overall positive charge. Such cationically dispersed suspensions are known to be useful in paper making as disclosed in published application EP-0278602A as well as for coating paper. However, such prior art dispersions have disadvantageous rheological properties.

It has now been found that the rheology of a cationically dispersed suspension of a mineral pigment or filler can be improved by using a mineral having a particular size distribution.

SUMMARY OF THE INVENTION

The invention relates to a method of coating paper with a paper coating composition having a solids concentration of at least 45% by weight. The paper coating composition consists essentially of an aqueous cationic dispersion of a particulate calcium carbonate pigment and a nonionic or cationic adhesive, wherein the pigment has a particle size distribution such that no more than 1% by weight of the particles have an equivalent spherical diameter larger than 10 microns, at least 65% by weight of the particles have an equivalent spherical diameter smaller than 2 microns and not more than 10% by weight of the particles have an equivalent spherical diameter smaller than 0.25 micron.

DETAILS OF THE INVENTION

The invention relates to a method of coating paper by applying a coating composition having a solids concentration of at least about 45% by weight, preferably at least 60% by weight solids. The coating composition consists essentially of an aqueous cationic dispersion of a particulate calcium carbonate pigment and a nonionic or cationic adhesive. The pigment will have a particle size distribution such that no more than 1% by weight of the particles have an equivalent spherical diameter larger than 10 microns, at least 65% by weight of the particles have an equivalent spherical diameter smaller than 2 microns and not more than 10% by weight of the particles have an equivalent spherical diameter smaller than 0.25 micron. The pigment is dispersed with a combination of a cationic polyelectrolyte and an anionic polyelectrolyte, with the amount of cationic polyelectrolyte being in the range of about 0.01% to about 1.5% by weight, based on the weight of the dry pigment, and with the amount of anionic polyelectrolyte being in the range of about 0.01% to about 0.5% by weight. The solids concentration of the composition, as determined at a given viscosity value as measured with a Brookfield viscometer (Model RVF) at a temperature of about 22° C. and at a spindle speed of about 100 rpm, will be at least about 3 percentage units higher, preferably at least 4 percentage units higher than that of an other paper coating composition which is identical to the paper coating composition of the invention, except that in such other paper coating composition, the pigment will have a particle size distribution such that no more than 1% by weight of the particles have an equivalent spherical diameter larger than 10 microns, at least 65% by weight of the particles will have an equivalent spherical diameter smaller than 2 microns and more than 10% by weight of the particles will have an equivalent spherical diameter smaller than 0.25 micron.

It is preferred that the inorganic material be a material which, when ground to a particulate mass, exists in the form of regular, approximate spherical particles having a low mean particle aspect ratio. Preferably, the inorganic material is a calcium carbonate pigment, in any form, natural or synthetic. Particularly preferred is ground marble, although precipitated calcium carbonate (PCC) and chalk are operable. Other possible inorganic materials are gypsum, talc and calcined kaolin clay. However, it is to be appreciated that other minerals having a plate-like structure, e.g. layer lattice silicates such as kaolin clay, are within the scope of the present invention.

Preferably, the inorganic material employed in the present invention should have a specific surface area, as measured by the BET N2 method, of less than about 7.5 $m^2g^{-1}$, more preferably less than about 6.5 $m^2g^{-1}$, and preferably at least 2 $m^2g^{-1}$.

The inorganic material may be ground, before dispersion, to the desired particle size distribution. The grinding conditions can be adjusted in a manner known per se to produce materials having varying distributions. It has been found that a cationic slurry prepared in accordance with the present invention will have a given viscosity at a higher solids level (at least about 3 percentage units higher solids level) than a slurry in which the inorganic material has a broader particle size distribution.

Where the inorganic material is a pigment or filler which carries a neutral or positive charge, such as marble, talc, gypsum or calcined kaolin clay, the particles of the material may be dispersed using a dispersing agent comprising a combination of an anionic polyelectrolyte and a cationic polyelectrolyte, the cationic polyelectrolyte being used in an amount sufficient to render the particles cationic. Although chalk particles, when in a raw state, do not carry a positive charge because of natural anionic species absorbed to the particle surface, chalk can be subjected to vigorous agitation in order to strip off such anionic species and render the mineral capable of being effectively dispersed at high solids using a combination of an anionic polyelectrolyte and cationic polyelectrolyte.

The high solids aqueous suspension of the present invention can be "made down" into a paper coating composition by dilution (if necessary) to a solids concentration of at least 45% by weight and by addition of an adhesive, which should be non-ionic or cationic in nature.

A full discussion of the constituents of paper coating compositions and of the methods of applying such compositions to paper is given in Chapter XIX, Volume III of the second edition of the book by James P. Casey entitled "Pulp and Paper: Chemistry and Technology". A further discussion is given in "An Operator's Guide to Aqueous Coating for Paper and Board", edited by T. W. R. Dean, The British Paper and Board Industry Federation, London, 1979.

For the purposes of the present invention, the components of the paper coating composition should be subjected to vigorous mixing before or after dispersion. Typically, the vigorous mixing should be sufficient to impart at least 10 kJ, preferably no more than 50 kJ, energy per kg of the inorganic material. Normally, the amount of energy input will be in the range of from 18–36 kJ per kg of the inorganic material.

The paper coating composition can be used in a method of coating a sheet member. The thus-formed coated paper is particularly suitable for recycling.

Ground marble for use in the paper coating composition is preferably formed by crushing batches of marble in aqueous suspension in the absence of a chemical dispersing agent using a particulate grinding medium. Further size reduction is achieved by dewatering the suspension of ground marble, for example by filtration, in the absence of a flocculating agent and then drying the pigment, and pulverizing the dried product in a conventional mill.

The particulate pigment is dispersed with the combination of an anionic polyelectrolyte and a cationic polyelectrolyte. Preferably, the anionic polyelectrolyte is a water-soluble vinyl polymer, an alkali metal or ammonium salt thereof or an alkali metal or ammonium salt of polysilicic acid. Most preferably, the anionic poly-electrolyte is a poly(acrylic acid), a poly(methacrylic acid), a substituted poly(acrylic acid) or a substituted poly(methacrylic acid), or an alkali metal or ammonium salt of any of these acids. The substituted poly(acrylic acid) may be a partially sulphonated polymer. An especially effective anionic polyelectrolyte is an alkali metal or ammonium salt of a copolymer of acrylic acid and a sulfonic acid derivative of acrylic acid, in which the proportion of the sulfonic acid derivative monomer is preferably from 5% to 20% of the total number of monomer units.

The number average molecular weight of the anionic polyelectrolyte is preferably at least about 500, and preferably no greater than about 100,000. The amount used is generally in the range of from about 0.01% to about 0.5% by weight based on the weight of dry pigment, preferably in the range of from about 0.1 to 0.2% by weight.

The cationic polyelectrolyte may be a water-soluble substituted polyolefin containing quaternary ammonium groups. The quaternary ammonium groups may be in the linear polymer chain or may be in branches of the polymer chain. The number average molecular weight of the substituted polyolefin is preferably at least about 1500 and preferably no greater than about 1,000,000, and is more preferably in the range of from 50,000 to 500,000. The quantity required is generally in the range of from about 0.01% to about 1.5% by weight based on the weight of dry pigment. Advantageous results have been obtained when the substituted polyolefin is a poly (diallyl di(hydrogen or lower alkyl)ammonium salt). The lower alkyl groups, which may be the same or different, may for example, have up to four carbon atoms and each is preferably methyl. The ammonium salt may be, for example, a chloride, bromide, iodide, HSO4-, CH3SO4- or nitrite. Preferably the salt is a chloride. Most preferably, the cationic poly-electrolyte is poly (diallyl dimethyl ammonium chloride).

Alternatively, the water-soluble substituted polyolefin may be the product of copolymerizing epichlorohydrin and an aliphatic secondary amine, and such product has a number molecular weight in the range of about 50,000 to about 300,000 and is composed of units having the formula:

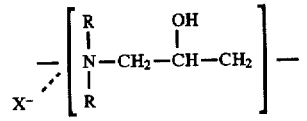

wherein R and R' are each hydrogen or the same or different $C_1$–$C_4$ alkyl group, preferably methyl or ethyl, and X is selected from the group consisting of $Cl^-$, $Br^-$, $I^-$, $HSO_4^-$, $CH_3SO_4^-$and nitrite.

Alternatively, the cationic polyelectrolyte may be a water-soluble organic compound having a plurality of basic groups and preferably having a number average molecular weight of at least about 10,000 and preferably no greater than about 1,000,000. Most preferably, the number average molecular weight is at least 50,000. These water-soluble organic compounds may be described as polyacidic organic bases, and are preferably compounds of carbon, hydrogen and nitrogen only and are free of other functional groups, such as hydroxy or carboxylic acid groups, which would increase their solubility in water and thus increase the likelihood of their being desorbed from the clay mineral in an aqueous suspension. Preferably, the organic compound is poly-ethyleneimine (PEI) having a number average molecular weight in the range of 50,000 to 1,000,000. A further example of a water-soluble organic compound which may be employed is a polyethylene diamine which may be a copolymer of ethylene diamine with an ethylene dihalide or with formaldehyde.

The cationic polyelectrolyte is employed in an amount sufficient to render the mineral particles cationic. Experiments have shown that the zeta potential of the particles will normally be at least +20 mV after treatment, typically in the range of from +30 to +40 mV and usually no greater than +50 to +60 mV. These potentials have been measured using a dilute (0.02 weight %) solids suspension using a supporting electrolyte of potassium chloride (10-4M) with a "Pen Kem Laser Z" meter.

The ratio of the weight of cationic polyelectrolyte to the weight of anionic polyelectrolyte used is preferably in the range of from about 2:1 to about 20:1, more preferably in the range of from 2:1 to 10:1.

In the method of the making the slurry of the invention, it is normally the case that the raw pigment is received as a filter cake having a relatively high solids content. To this is added the dispersing agent in order to provide a dispersed high solids slurry (45–80% by weight solids) which may then be subjected to vigorous mixing.

Where the pigment is to be dispersed using a combination of an anionic and cationic polyelectrolyte, the pigment is mixed with the anionic polyelectrolyte before mixing with the cationic polyelectrolyte. This appears to enable a more fluid suspension to be obtained at a higher solids concentration.

The aqueous suspension may also include other conventional paper coating composition adjuvants such as an insolubilizing agent (e.g. a melamine formaldehyde resin), a lubricant such as calcium stearate and a catalyst to catalyze cross-linking of the cationic latex if present; a suitable such catalyst is sodium bicarbonate. The quantities of these adjuvants required are known to those skilled in the art.

The adhesive used in making the paper coating composition should be a non-ionic or a cationic adhesive. Such adhesives contrast with the anionic adhesives which are normally used in paper coating compositions in which the pigment is anionic. Thus, cationic casein and cationic starch adhesives can be used as well as cationic or non-ionic lattices. Such cationic and non-ionic adhesives are readily commercially available. The particular cationic or non-ionic adhesive used will depend, for example, on the printing process to be used, e.g. offset lithography requires the adhesive to be water-insoluble. For paper to be used in an offset printing technique, the amount of adhesive should preferably be of the order of from 7 to 25% by weight, based on the weight of pigment whilst, for gravure printing paper, the adhesive should be used in an amount of 4–15% by weight, based on the weight of pigment. The precise quantity of adhesive required will depend upon the nature of the adhesive and the material being coated, but this can readily be determined by the person skilled in the art.

The coating composition may be coated on to a sheet member using normal paper coating machinery and under normal paper coating conditions. It has been found that the paper coated with a cationic composition in accordance with the present invention provides broadly similar results to that obtained with a conventional anionic system.

The coated paper which may be made using the present invention is of advantage when it is employed as "broke" or recycled paper in a paper making process. Commonly, large quantities of paper are recycled at the point of manufacture for one reason or another, and the advantages of the paper of the present invention in recycling are most important to the paper manufacturer. Such a method for recycling paper includes the step of reducing the paper into a fibrous recyclable state and incorporating said fibre in a paper-making composition.

Such a paper-making composition may include conventional paper-making pulp, such as a bleached sulphite pulp and, typically, the broke fibre and the pulp will be employed in a ratio of from 10:90 to 60:40. Also included in the paper making composition will be a filler, for instance a calcium carbonate filler and also a retention aid. Since the broke fibre will include a proportion of calcium carbonate from the coating, it is possible to reduce the amount of calcium carbonate filler employed to give a total quantity of filler in the range of from 5 to 20 percent by weight of the total paper-making composition. The weight of dried broke added (fibre and filler) should preferably be in the range of from about 5 to 30 percent by weight of fibre.

It has been found that, when the broke fibre employed is derived from a coated paper in accordance with the invention, this enables the amount of retention aid employed in the paper making composition to be reduced. The method of the invention is also particularly suited to paper filling.

The present invention will now be illustrated by the following Examples:

EXAMPLE 1

Two calcium carbonate pigments were prepared by low solids sand grinding of marble flour. Adjustment of grinding conditions allowed products of varying widths of distribution to be compared. The particle size distributions of Samples A and B were determined by means of a SEDIGRAPH™ particle size analyzer and the results are set forth in Table I below (percentages given are weight %):

TABLE I

| SAMPLE A | SAMPLE B |
|---|---|
| 0.3% > 10 μm | 0.8% > 10 μm |
| 75.5% < 2 μm | 70.2% < 2 μm |
| 44.5% < 1 μm | 48.0% < 1 μm |

TABLE I-continued

| SAMPLE A | SAMPLE B |
|---|---|
| 20.0% < 0.5 μm | 28.5% < 0.5 μm |
| 6.7% < 0.25 μm | 14.3% < 0.25 μm |
| Surface Area (BET N2) 5.0 $m^2g^{-1}$ | 8.6 $m^2g^{-1}$ |

Both samples were filtered to give a filter cake of between 70–75% solids. This cake was then cationically dispersed using a pretreatment of sodium polyacrylate (Molecular weight 4000) followed by addition of a larger dose of polydadmac [i.e. a poly(diallyl dimethyl ammonium chloride)] of molecular weight of 500,000 followed by addition of a larger dose of the polydadmac. The ratio of cationic to anionic polymer was maintained at between 3.2 and 3.5:1 by weight. The suspension was diluted with water until a viscosity, measured at 100 rpm @ 22° C. using a Brookfield Viscometer (Model RVF), of approximately 600 mPa.s was reached and the solids content of the suspension determined.

TABLE II

SAMPLE A Dispersion on a High Speed Mixer

| Dose of anionic polyacrylate wt % | Dose of poly-dadmac wt % | Solids wt % | Brookfield viscosity mPa.s |
|---|---|---|---|
| 0.11 | 0.34 | 70.3 | 600 |

TABLE III

SAMPLE B Dispersion on a High Speed Mixer

| Dose of anionic polyacrylate wt % | Dose of poly-dadmac wt % | Solids wt % | Brookfield viscosity mPa.s |
|---|---|---|---|
| 0.11 | 0.34 | 65.0 | 600 |
| 0.125 | 0.44 | 66.6 | 660 |
| 0.135 | 0.47 | 66.3 | 635 |

Hence in Example 1, a ground marble having a broad size distribution gives approximately 4 percentage units lower solids for a given rheology when cationically dispersed.

EXAMPLE 2

Two calcium carbonate paper coating pigments corresponding to Sample C of the invention and Sample D for comparative purposes were prepared by low solids sand grinding of marble flour in the absence of any chemical dispersing agent. Comparative Sample D was prepared by continuing the sand grinding operation until the particle size distribution of the ground marble was such that approximately 90% by weight consisted of particles having an equivalent spherical diameter smaller than 2 μm. Sample C of the invention, on the other hand, was prepared by grinding the marble flour until the particle size distribution was such that 75% by weight consisted of particles having an equivalent spherical diameter smaller than 2 μm, and the ground product was then subjected to particle size classification in a centrifuge to yield a fine fraction which had a particle size distribution such that approximately 90% by weight consisted of particles having an equivalent spherical diameter smaller than 2 μm. Although both Sample C and Sample D had substantially the same proportion by weight of particles having an equivalent spherical diameter smaller than 2 μm, Sample C was found to have a steeper or narrower particle size distribution curve (in accordance with the present invention) than Sample D.

The particle size distributions of Samples C and D were determined by means of a SEDIGRAPH™ particle size analyzer and the results are set forth in Table IV below:

TABLE IV

| | SAMPLE C (Invention) | SAMPLE D (Comparative) |
|---|---|---|
| % by weight > 10 μm | 0.02 | 0.01 |
| % by weight < 2 μm | 92.0 | 89.0 |
| % by weight < 1 μm | 49.0 | 62.0 |
| % by weight < 0.5 μm | 23.0 | 33.0 |
| % by weight < 0.25 μm | 7.0 | 14.0 |
| Surface Area (BET $N_2$, $m^2g^{-1}$) | 6.7 | 8.6 |

The suspension containing each sample was filtered to give a filter cake having a dry solids content in the range of 70–75% by weight. This cake was then cationically dispersed using a pretreatment of the same sodium polyacrylate dispersing agent as was used in Example 1. The weight ration of cationic to anionic dispersing agent was maintained in the range of 3.4:1 to 3.5:1. The suspensions were each diluted with water, and measurements of the viscosities of the suspensions were made at different solids concentrations using a Brookfield Viscometer Model RVF at a spindle speed of 100 rpm and at 22° C. and the indicated spindle number. The results are set forth in Table V below:

TABLE V

| Dose of dispersing agent (% by weight) | | SAMPLE C | | | SAMPLE D | | |
|---|---|---|---|---|---|---|---|
| Anionic | Cationic | % by weight solids | Viscosity (mPa · s) | Spindle No. | % by weight solids | Viscosity (mPa · s) | Spindle No. |
| 0.175 | 0.60 | 65.6 | 800 | 4 | — | — | — |
| | | 64.6 | 350 | 3 | 64.7 | 5200 | 6 |
| | | 63.8 | 240 | 3 | 63.8 | 3000 | 5 |
| | | — | — | — | 62.5 | 1080 | 5 |
| | | — | — | — | 61.7 | 579 | 3 |
| | | — | — | — | 60.6 | 380 | 3 |
| 0.195 | 0.69 | 66.1 | 1400 | 5 | — | — | — |
| | | 65.1 | 545 | 3 | — | — | — |
| | | 64.2 | 270 | 3 | 63.8 | 4500 | 6 |
| | | — | — | — | 62.7 | 1920 | 5 |
| | | — | — | — | 61.0 | 600 | 4 |

Reference is now made to accompanying FIGS. 1 and 2 which relate to the results obtained in Example 2.

It is known that if the percentage by weight of solids in a suspension is plotted against the reciprocal of the square root of the viscosity (as measured by means of a Brookfield Viscometer Model RVF at a spindle speed of 100 rpm and a temperature of 22° C.), an approximately straight line is obtained. Graphical plots of percentage by weight of solids against the reciprocal of the square root of the viscosity were produced for the suspension containing 0.175% by weight of the anionic dispersing agent and 0.60% by weight of the cationic dispersing agent (FIG. 1), and for the suspension containing 0.195% by weight of the anionic dispersing agent and 0.69% by weight of the cationic dispersing agent (FIG. 2) respectively; the percentages by weight of the dispersing agents were based on the weight of dry calcium carbonate.

When the viscosity is 600 mPa.s, the value of the reciprocal of the square root of the viscosity is 0.0408, and this value is shown on FIGS. 1 and 2 as a dotted line.

FIG. 1 shows that the suspension of the calcium carbonate pigment having a relatively narrow particle size distribution (Sample C) has a solids concentration at a viscosity of 600 mPa.s which is approximately 3.5 percentage units higher than that of the suspension of calcium carbonate which has a relatively broad particle size distribution (Sample D) for the same viscosity. Similarly, FIG. 2 shows that the suspension of Sample C has a solids concentration at a viscosity of 600 mPa.s which is approximately 4.2 percentage units higher than that of the suspension of Sample D for the same viscosity.

What is claimed is:

1. In a method of coating paper with a paper coating composition, the improvement which comprises applying a coating composition having a solids concentration of at least about 45% by weight, consisting essentially of an aqueous cationic dispersion of a particulate calcium carbonate pigment and a nonionic or cationic adhesive, wherein the, pigment has a particle size distribution such that no more than 1% by weight of the particles have an equivalent spherical diameter larger than 10 microns, at least 65% by weight of the particles have an equivalent spherical diameter smaller than 2 microns and not more than 10% by weight of the particles have an equivalent spherical diameter smaller than 0.25 micron, and wherein said pigment is dispersed with a combination of a cationic polyelectrolyte and an anionic polyelectrolyte, with the amount of cationic polyelectrolyte being in the range of about 0.01% to about 1.5% by weight, based on the weight of the dry pigment, and with the amount of anionic polyelectrolyte being in the range of about 0.01% to about 0.5% by weight, said solids concentration, as determined at a given viscosity value as measured with a Brookfield viscometer at a temperature of about 22° C. and at a spindle speed of about 100 rpm, being at least about 3 percentage units higher than that of an other paper coating composition which is identical to said paper coating composition except that in said other paper coating composition, the pigment has a particle size distribution such that no more than 1% by weight of the particles have an equivalent spherical diameter larger than 10 microns, at least 65% by weight of the particles have an equivalent spherical diameter smaller than 2 microns and more than 10% by weight of the particles have an equivalent spherical diameter smaller than 0.25 micron.

2. The method of claim 1 wherein said solids concentration is at least about 4 percentage units higher than that of said other paper coating composition.

3. The method of claim 1 wherein the coating composition has a solids concentration of at least 60% by weight.

4. The method of claim 1 wherein the pigment has a specific surface area, as measured by the BET $N_2$ method, of less than about 7.5 $m^2g^{-1}$.

5. The method of claim 4 wherein the pigment has a specific surface area, as measured by the BET $N_2$ method, of less than about 6.5 $m^2g^{-1}$ and at least 2 $m^2g^{-1}$.

6. The method of claim 1 wherein the cationic polyelectrolyte comprises a water-soluble substituted polyolefin containing quaternary ammonium groups and having a number average molecular weight in the range of about 1,500 to about 1,000,000.

7. The method of claim 6 wherein the substituted polyolefin has a number average molecular weight in the range of 50,000 to 500,000.

8. The method of claim 6 wherein the cationic polyelectrolyte is a poly[diallyl di(hydrogen or $C_1$–$C_4$ alkyl)] ammonium salt.

9. The method of claim 8 wherein the cationic polyelectrolyte is poly(diallyl dimethyl) ammonium chloride.

10. The method of claim 6 wherein the polyolefin is the product obtained by copolymerizing epichlorohydrin and aliphatic amine, and such product has a number molecular weight in the range of about 50,000 to about 300,000 and is composed of units having the formula:

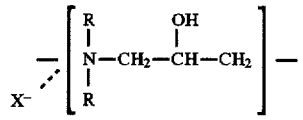

wherein R and R' are each hydrogen or the same or different $C_1$–$C_4$ alkyl group and X is selected from the group consisting of $Cl^{31}$, $Br^-$, $I^-$, $HSO_4^-$, $CH_3SO_4^-$and nitrite.

11. The method of claim 1 wherein the cationic polyelectrolyte comprises a water-soluble polyacidic organic base having a number average molecular weight of about 10,000 to about 1,000,000.

12. The method of claim 11 wherein the organic base is polyethyleneimine having a number average molecular weight of 50,000 to 1,000,000.

13. The method of claim 1 wherein the anionic polyelectrolyte is present in an amount in the range of about 0.1 to 0.2% by weight, based on the weight of dry pigment.

14. The method of claim 1 wherein the ratio of the weight of cationic polyelectrolyte to the weight of anionic polyelectrolyte is in the range of from about 2:1 to about 20:1.

15. The method of claim 14 wherein the ratio of the weight of cationic polyelectrolyte to the weight of anionic poly-electrolyte is in the range of from about 2:1 to 10:1.

16. The method of claim 1 wherein the anionic polyelectrolyte has a number average molecular weight of about 500 to about 100,000.

17. The method of claim 16 wherein the anionic polyelectrolyte is a water-soluble vinyl polymer, an alkali metal salt of such polymer, an ammonium salt of such polymer, an alkali metal salt of polysilicic acid or an ammonium salt of polysilicic acid.

18. The method of claim 17 wherein the anionic polyelectrolyte is a poly(acrylic acid), a poly(methacrylic acid), a substituted poly(acrylic acid), a substituted poly (methacrylic acid), or an alkali metal or ammonium salt of any of the foregoing acids.

19. The method of claim 18 wherein the anionic polyelectrolyte is an alkali metal or ammonium salt of a copolymer of an acrylic acid monomer and a monomer comprising a sulfonic acid derivative of acrylic acid, and the sulfonic acid derivative monomer is from 5 to 20% of the total number of monomer units contained in such copolymer.

20. The method of claim 1 wherein the amount of adhesive present in the coating composition is 7 to 25% by weight, based on the weight of pigment and the paper coated by such method is used for offset printing.

21. The method of claim 1 wherein the amount of adhesive present in the coating composition is 4 to 15% by weight, based on the weight of pigment and the paper coated by such method is used for gravure printing.

22. The method of claim 1 wherein the given viscosity value is about 600 mPa.s.

* * * * *